US011519075B2

(12) United States Patent
Irissou et al.

(10) Patent No.: US 11,519,075 B2
(45) Date of Patent: Dec. 6, 2022

(54) POROUS METAL COATINGS USING SHOCKWAVE INDUCED SPRAYING

(71) Applicant: National Research Council of Canada, Ottawa (CA)

(72) Inventors: Eric Irissou, Montreal (CA); Louis-Philippe Lefebvre, Montreal (CA)

(73) Assignee: National Research Council of Canada, Ottawa (CA)

( * ) Notice: Subject to any disclaimer, the term of this patent is extended or adjusted under 35 U.S.C. 154(b) by 1067 days.

(21) Appl. No.: 16/098,688

(22) PCT Filed: May 5, 2017

(86) PCT No.: PCT/IB2017/052634
§ 371 (c)(1),
(2) Date: Nov. 2, 2018

(87) PCT Pub. No.: WO2017/191611
PCT Pub. Date: Nov. 9, 2017

(65) Prior Publication Data

US 2021/0238750 A1 Aug. 5, 2021

Related U.S. Application Data

(60) Provisional application No. 62/332,261, filed on May 5, 2016.

(51) Int. Cl.
*C23C 24/04* (2006.01)
*B05B 7/12* (2006.01)
(Continued)

(52) U.S. Cl.
CPC ..... *C23C 24/04* (2013.01); *B05B 7/12* (2013.01); *B05B 7/1463* (2013.01);
(Continued)

(58) Field of Classification Search
None
See application file for complete search history.

(56) References Cited

U.S. PATENT DOCUMENTS 7,854,958 B2 12/2010 Kramer
8,192,792 B2 6/2012 Haynes et al.
(Continued)

FOREIGN PATENT DOCUMENTS

EP 2202328 A1 6/2010
WO 2010092677 A1 8/2010

OTHER PUBLICATIONS

Sun, J, Han, Y, Cui, K. Innovative Fabrication of Porous Titanium Coating on Titanium et al., Materials Letters 62, 2008, 3623-3625.
(Continued)

*Primary Examiner* — Shamim Ahmed
*Assistant Examiner* — Bradford M Gates
(74) *Attorney, Agent, or Firm* — Jason E. J. Davis

(57) ABSTRACT

A new spray process allows for deposition below a critical velocity limit of cold spray, while providing adhesion. Post deposition heat treatment has shown excellent coating strength. A wide variety of materials can be deposited. The spray process is based on ShockWave Induced Spraying (SWIS) but with much slower spray jet projection velocities. High porosity, pore size control, and porosity control are demonstrated to be controllable. Preheating of feedstock and uniform temperature of the SWIS delivery allow for the deposition below critical velocity.

20 Claims, 4 Drawing Sheets

(51) Int. Cl.

| | |
|---|---|
| ***B05B 7/14*** | (2006.01) |
| ***B05B 7/16*** | (2006.01) |
| ***B05B 15/00*** | (2018.01) |
| ***C23C 30/00*** | (2006.01) |

(52) U.S. Cl.
CPC ..... *B05B 7/1486* (2013.01); *B05B 7/1666* (2013.01); *B05B 15/00* (2013.01); *C23C 30/005* (2013.01)

(56) References Cited

U.S. PATENT DOCUMENTS

| | | | | |
|---|---|---|---|---|
| 8,298,612 | B2 | 10/2012 | Jodoin | |
| 2008/0102220 | A1* | 5/2008 | Haynes | F01D 5/12 427/421.1 |
| 2008/0233282 | A1* | 9/2008 | Jodoin | C23C 4/126 118/308 |
| 2009/0176005 | A1* | 7/2009 | Kramer | A61L 27/34 427/427 |

OTHER PUBLICATIONS

Li, Wen-Ya, Zhang, Chao, Guo, Xueping, Xu, Jinling, Li Chang-Jiu, Liao, Hanlin, Coddet Christian , Khor Khiam Aik, Ti and Ti-6Al-4V Coatings by Cold Spraying and Microstructure Modification by Heat Treatment, Advanced Engineering Materials, 2007, vol. 9 No. 5; 418-423.

Wong, Wilson, Powder Processing and Counting Heat Treatment, 2012, vols. 706-709, 258-263.

Zahiri, S.H., Fraser, D, Jahedi, M. Recrystallization of Cold Spray-Fabricated CP Titanium Structures, Journal of Thermal Spray Technology. 2009; 18(1):16-22.

Blose R. E., Walker, B.H., Walker, R. M., and Froes,S.H., New Opportunities to Use Cold Spray Process for Applying Additive Features to Titanium Alloys, Met. Powder Rep., 2006; 61 (9) 30-37.

Stoltenhoff T. , Borchers C., Gartner F. , Kreyeh. , Microstructures and Key Properties of Cold-Sprayed and Thermally Sprayed Copper Coatings 2005, 4947-4960.

Lee, Ha Yong., Jung, Se. Hun., Lee, ,Soo Yong, Ko, Kyung Hyun, Fabrication of Cold Sprayed Al-Intermetallic Compounds Coatings by Post Annealing, Mater. Sci. Eng. A, 2006, 433;139-143.

Li, Wen Ya, Li, Chang-Jiu, Liao Hanlin, Effect of Annealing Treatment on Microstructure and Properties of Cold-Sprayed Cu Coating, Journal of Thermal. Spray Technology., 2006, vol. 15(2), p. 206-211.

Blose, R E., Spray Forming Titanium Alloys Using Cold Spray Process, Thermal Spray 2005; Thermal Spray Connects: Explore Its Surfacing Potential! E. Lugscheider Ed., ASM International, Materials Park,OH, 2005, p. 199-207.

Li, W. Y., Guo, X. P. , Verdy, C. , Dembinski, L. , Liao, H. L. , Coddet, C., Improvement of Microstructure and Property of Cold-Sprayed Cu-4at.%Nb Alloy by Heat Treatment. Scripta Materialia. 2006, 55;327-330.

Karimi, Mo, Rankin, Gary W., Jodoin, Bertrand; Shock-wave Induced Spraying: Gas and Particle Flow and Coating Analysis, Surface and Coatings Technology, vol. 207, Aug. 25, 2012, pp. 435-442.

Villafuerte Julio, Zheng, Wenyue; Corrosion Protection of Magnesium Alloys by Cold Spray, 2011 ,Chapt 9, 185-194, Frank Czerwinski (Ed.); Magnesium Alloys—Corrosion and Surface Treatments, Jan. 2011.

Vo, P., Irissou, E., Legoux, J.-G, Yue, S.; Mechanical and Microstructural Characterization of Cold-Sprayed Ti—6Al-4V After Heat Treatment, 2013 vol. 22(6), 954-964.

Li, Wen-Ya , Zhang, Chao , Guo, Xueping , Xu, Jinling , Li, Chang-Jiu, Liao, Hanlin , Coddet, Christian, Khor, Khiam Aik ; Advanced Engineering Materials 2007, 9, No. 5; 418-423.

Marrocco, T. McCartney, D. G., Shipwy, P.H., and Sturgeon, A.J., Production of Titatium Deposits by Cold-gas Dynamic Spray et al, 2005 vol. 15, 263-266.

Yue, S., Pilliar, R. M., Weatherly G.C., The Fatigue Strength of Porous-Coated Ti—6%Al-4% V Implant Alloy, Journal of Biomedical Materials Research, 1984, vol. 18, 1043-1058.

Wolfarth, D., Ducheyne P., Effect Of A Change in Interfacial Geometry On The Fatique Strength of Porous-Coated Ti—6Al—4V, Journal of Biomedical Materials Research ,1994, vol. 28, 417-425.

Simmons, Craig A., Valiquette, Nancy, Pilliar Robert M., Osseointegration of Sintered Porous-Surfaced and Plasma Spray-Coated Implants et al. Institute of Biomaterialsand Biomedical Engineering,1999, 127-138.

Ryan, Garrett, Pandit, Abhay, Apatsidis, Dimitrios Panagiotis, Fabrication Methods of Porous Metals for Use in Orthopaedic Applications, Biomaterials 2006, 2651-2670.

Qiu, Dong, Zhang, Mingxing, Grondahl, Lisbeth, A Novel composite Porous Coating Approach for Bioactive Titanium-Based Orthopedic Implants, School of Mechanical and Mining Engineering, University of Queensland, St. Lucia, Queensland, Australia, 2012, 862-872.

Price, T.S., Shipway,P.H., McCartney, Effect of Cold Spray Deposition of a Titanium Coating on Fatigue Behavior of a Titanium Alloy, 2006, vol. 15(4) 507-512.

Messersmith, Phillip B., Cooke, Francis W., Stress Enhancement and Fatigue Susceptibility of Porous Coated Ti—6Al-4V Implants: An Elastic Analysis, 1990, vol. 24, 591-604.

Matassi, Fabrizio, Botti, Alessandra, Sirleo, Luigi, Carulli, Christian, Innocenti, Massimo, Porous Metal for Orthopedics Implants, Clinical Cases in Mineral and Bone Metabolism, 2013, 1-11.

Martell, John M. Pierson, Raymond H., Jacobs, Joshua J., Rosenberg, Aaron G., Maley, Maryellen, Galante, Jorge O., Primary Total Hip Reconstructions with a Titanium Fiber-Coated Prosthesis Inserted without Cement, The Journal of Bone and Joint Surgery, Incorporated, 1993, vol. 75-A, No. 4; 554-571.

Yandouzi, H., Bu, H., Brochu, M., Jodoin, Nanostructured Al-Based Metal Matrix Composite Coating Production by Pulsed Gas Dynamic Spraying Process, Journal of Thermal Spray Technology, 2012, vol. 21(3-4), pp. 609-619.

Li, Chang-Jiu, Li Wen-Ya, Deposition Characteristics of Titanium Coating in Cold Spraying, Surface and Coatings Technology 167, 2003; 278-283.

Gardon, M., Latorre A., Torrell, M. Dosta S. , Fernandez J. Guilemany J.M., Cold Gas Spray Titanium Coatings onto a Biocopatible Polymer, Materials Letters 106, 2013; 97-99.

Fabi, D. W. , Levine, B. R., Porous Coatings on Metallic Implant Materials, Medical Implant Materials, 2012, 308-319.

Ducheyne, Paul, Martens, Marc, Orderly Oriened Wire Meshes As Porous Coatings on Orthopaedic implants I: Morphology, Clinical Materials 1986; 1: 59-67.

Choudhuri, A., Mohanty, P.S., Karthikeyan, J., Bio-Ceramic Composite Coatings by Cold Spray Technology, Additive Manufacturing Process Laboratory, 2009.

Jodoin, B., Richer, P., Berube, G., Ajdelsztajn, L., Erdi-Betchi, A., Yandouzi, M., Pulsed-Gas Dynamic Spraying: Process Analysis, Development and Selected Coating Examples, Surface & Coatings Technology 201, 2007; 7544-7551.

Schmidt. T., From Particle Acceleration to Impact and Bonding in Cold Spraying, Journal of Thermal Spray Technology Dec. 2009, 18:1038.

Karimi, Mo, Jodoin, Bertrand and Rankin, Gary, Shock-Wave-Induced Spraying: Modeling and Physics of a New Spray Process , Journal of Thermal Spray Technology 20(4), 2011, pp. 866-881.

* cited by examiner

POROUS METAL COATINGS USING SHOCKWAVE INDUCED SPRAYING

CROSS-REFERENCE TO RELATED APPLICATIONS

The present invention is a national phase entry of International PCT patent application PCT/IB2017/052634 filed on May 5, 2017 which claims priority on U.S. patent application 62/332,261, filed May 5, 2016, the contents of which are incorporated herein by reference.

FIELD OF THE INVENTION

The present invention relates in general to a technique for producing a porous coating using a Shockwave Induced Spraying (SWIS) device; and in particular to a method for producing porous coatings with improved control over the porosity using a SWIS device.

BACKGROUND

Porous metal coatings have applications in a number of fields. Depending on an amount of the porosity, a variety of applied coatings may be produced for particular functions. For example, it is known to produce porous coatings by low cost thermal spray (such as plasma spray, flame spray, arc spray and high velocity oxide fuel spray). When applying these techniques with reactive metals such as titanium, the deposition is usually done in a vacuum to avoid oxidation and impurities.

Porous coatings are used as electrodes, for high surface area electrical contact interfaces, if the coatings are sufficiently conductive. If the coatings are sufficiently porous and brittle, they can be used as abradable seals in turbomachinery. If the coatings are biocompatible and have acceptable porosity and pore dimensions, they can be applied in orthopedic applications to provide improved biological fixation and longevity of cementless implants, where the porous metallic matrix facilitates bone ongrowth/ingrowth, and improved: load transfer between the implant and the bone; and stability of the implant.

Heretofore these porous coatings have most often been applied via sintering of beads, fibers or meshes, and thermal spray (1, 2). Alternative techniques to thermal spray, sintered beads and meshes for fabricating porous titanium coatings for such applications are desirable.

Porous sintered bead coatings are applied by binding and sintering one or more layers of metal beads on a substrate to be coated (1). It often requires machining of a pocket into which the beads are laid (3). Ti sintering is usually performed in a high vacuum oven at temperatures of around 1250° C., which creates metallurgical bonds joining adjacent beads and between the coating and the substrate (1, 4). The joining appears as sinter "necks" that have properties that are associated with the sintering time and temperature (3). Porosities of up to 50% can be achieved with suitable particle interconnectivity and particle size distribution (1).

Despite the proven success of bead sintering, it is not without problems. This technique is labour-intensive and often requires machining, which increases manufacturing time and cost. High temperature sintering (above 1000° C.) may result in brittle microstructures with large grain sizes (6), thereby affecting its strength which may be undesirable. Furthermore, binder residues may proscribe certain binders from use in certain applications, and add costs to the process.

Furthermore, these coating are problematic specifically for implant applications. The resulting porous coatings have significantly reduced fatigue strength. The fatigue strength has been found to be as little as one-third that of the solid alloy equivalent (5, 6). The sintered neck regions located at the interface between the coating and the substrate create areas of stress concentration and facilitate crack propagation.

Fiber sintering is another technique of producing porous coatings. As the names suggest, the principal difference between these techniques are that the beads are substituted for fibers (7). This technique calls for compaction of fibers in a form, prior to sintering, which complicates the coating of complex shapes on substrates of non-trivial geometry. Fiber spring-back during metal fiber compaction is also of concern if good bonding between the coating and the substrate is required. Metallurgical bonds are created at the points of contact between fibers and resulting porosities are limited to 30-50% (1). Fiber coatings fail by means of tearing of the bonds between fibers instead of crack propagation.

In order to minimize the risk of fiber detachment, wire mesh coatings were created by weaving continuous wires into a regular meshwork. The mesh is precompacted onto the implant to improve contact zones, and sintered at 925° C. (8). Large and uniform pore size with interconnectivity has been demonstrated, depending on the wire diameter, inter-wire spacing and geometric distribution of the wires. Nonetheless the high sintering temperatures limit the substrates available, as they may affect many substrates. The process has many steps and complicated arrangements of parts. When the substrate geometry is non-trivial, the wires and mesh arrangement can be particularly challenging.

Thermal spray, predominantly vacuum plasma spray, is another commonplace technique to produce porous surface coatings (1, 4, 9). It typically utilizes an electric arc to ionize a gas and form a high temperature plasma jet (over 10,000° C.), which expands and accelerates towards the substrate. Powder injected into the plasma jet, melts, and is propelled as a spray jet towards the substrate. The particles quench upon impact and bond with the surface. The velocity of the stream can be adjusted to create stronger bonds or varying degrees of porosity. The main advantage of vacuum plasma spray over bead, fiber or mesh sintering is that the temperature of the implant remains lower and therefore does not negatively affect fatigue strength and ductility of the substrates, and increases the variety of substrates that can be so coated. Also, coating is directly applied to the surface which allows the coating of almost arbitrarily complex shapes. However, vacuum plasma spray does not produce the highest porosity coatings when compared to bead, wire or mesh sintering, and may have irregular pores, low interconnectivity and lower porosity ranging from 30-50%.

The FDA guidelines required to evaluate the performance of titanium plasma spray coatings are listed in Table 1. These are relevant for some applications of this technology.

| | | |
|---|---|---|
| ASTM F1854 | Coating thickness | 450-750 μm |
| ASTM F1854 | Porosity | 20-40% |
| ASTM F1147 | Tensile strength | >22 MPa |
| ASTM F1044 | Shear strength | >20 MPa |
| ASTM F1978 | Abrasion | <65 mg/100 cycles |
| ISO 4287/4288 | Roughness | >100 μm |

Newer spray methods such as cold spray are being investigated for biomedical purposes (11). Cold spray deposition involves propelling powder particles onto a substrate, typically with supersonic velocities (500-1000 m/s). Particles undergo plastic deformation at impact with the substrate and adhere to the surface. Unlike other thermal spray processes, the powder is not melted during spraying process. The coating built-up is thus the result of the conversion of kinetic energy of the particles to plastic deformation energy during bonding with the surface instead of solidification of liquid droplets.

Some investigators have studied cold sprayed titanium coatings onto titanium or polymeric substrates without heat treatment (11-14). For example, to improve biocompatibility of polyetheretherketone (PEEK) implants, Gardon et al. (11) applied a titanium coating onto the polymer substrate using cold spray technology. Price et al. (12) cold sprayed titanium coatings onto Ti6Al4V substrates using commercially pure (CP) Ti powder with a particle size range of −45/+5 μm, but the coatings were not porous. The resulting coating was examined and it was found to have high bond strength but a low four-point-bending moduli. Cold sprayed coatings have also been found to reduce a fatigue endurance limit of Ti6Al4V substrates. Cold-sprayed titanium composite coatings consisting of hydroxyapatite and titanium were also developed (15, 16). Choudhuri et al. (15) produced dense CP Ti coatings containing up to 30% hydroxyapatite with bond strength comparable to that of the plasma sprayed hydroxyapatite. Marrocco et al. (13) investigated the use of two different titanium particle size ranges (coarser −45/+5 μm, and finer −25/+5 μm) of feedstocks for cold spray onto Ti6Al4V substrates. The coarser powder generated denser coatings with a porosity level of 13% compared to porosities ranging from 17 to 23% for the fine powders. Bond strengths between the coating and substrate ranged from 10 to 24 MPa. Marrocco et al. (13) finds that cold spray conditions could not be altered to avoid porosity in the 10-30% levels. While cold spray offers a new process for coating, it is not without limitations. In the words of Marrocco et al.:

For a given material, successful deposition requires a certain minimum particle velocity or "critical velocity," the value of which depends most significantly on the thermomechanical properties of the powder and substrate materials (Ref 10-16); below this critical velocity, impacting particles are generally observed to cause erosion of the substrate.

Thus this critical velocity requirement of cold spray is a limitation on producing a wider range of coatings.

Some investigators have applied a heat treatment following the cold-spray deposition of titanium powders (17-26). For example, Sun et al. (17) fabricated cold sprayed porous titanium coatings using titanium powders (10-45 μm, 25 vol. %) blended with magnesium powders (63-73 μm, 75 vol. %). Post deposition, the coating was sintered in a vacuum chamber at 1250° C. for 1 hour, which completely evaporated the magnesium and created a porous titanium coating with a uniformly distributed, open and interconnected pore structure. Porosity of 48%, pore sizes ranging from 70 to 150 μm and tensile strengths of 42 MPa were achieved. Qiu et al. (16) fabricated porous coatings having an open-cell structure with 50-150 μm pore size, bond strength of 20 MPa and 60-65% macroporosity. Qiu et al. (16) mixed an aluminium porogen into titanium feedstock powders to generate a porous cold sprayed coating annealed in a vacuum furnace at 1200° C. for 2 hr. Porosities of approximately 50% and pore sizes ranging from 50-150 μm were achieved. Thus porogen co-sprayed (cold sprayed) coatings can be used to produce high porosity, but only if heated at a temperature well above 1200° C.

Another study conducted by Li et al. (18) investigated the cold spraying of CP Ti (12-39 μm) and Ti6Al4V (23-85 μm) coatings followed by a heat treatment at 850° C. for 4 hours under vacuum. Porosities under 30% were achieved and the addition of heat resulted in improved metallurgical interfacial bonding between particles due to atom diffusion and grain boundary migration. Vo et al. (19) investigated a range of heat treatment temperatures and time following Ti6Al4V (30 μm) cold-spray deposition onto Ti6Al4V substrates. They found that heat treatment at 600° C. or higher decreased hardness but increased tensile strength. Heat treatment time had little effect on tensile properties and porosities in the coatings were under 12%. Blose et al. (22) reported cold sprayed titanium and its alloy coatings with porosities between 5-25% when heat treated or hot isostatic pressed. Thus cold spray porous coatings without porogen co-spray tend to produce too little porosity, or too little control over pore size.

Another application space of interest for porous metal coatings, is for abradable seals. Abradable coatings are designed to wear off gradually within a turbomachinery in order to optimize the clearance between rotating and stationary components. Coating porosity contributes to the gradual wear of the abradable coatings and production of tight seals. Tight seals are essential to optimizing engine power output and reducing fuel consumption. In accordance with the prior art, abradable feedstock is typically deposited by atmospheric plasma spray (APS) and the coating porosity is controlled through an amount a co-sprayed polymer porogen, which becomes entrapped in the coating. The coating requires post-deposition polymer-removing heat treatment to create the desired porosity. This coating manufacturing method poses a number of challenges (for instance to the aerospace industry) due to the lack of consistency in abradable coatings mechanical properties. This can cause reliability issues, which may consequently lead to certification challenges. Furthermore, there are environmental issues with vaporized polymer, in the heat treatment step.

The SWIS process (also known as pulsed gas dynamic spray) is a known method of applying metallic and composite coatings onto a wide range of substrates by making use of the kinetic and thermal energy induced by a moving shock-wave to accelerate and heat metallic powders. This process is a variant of the well-known cold-gas dynamic spray material deposition technique (simply referred to as cold spray herein) except that it utilizes a train of gas pulses in an unsteady, interrupted, flow. Similarly to cold spray, particles impact on substrate and deform plastically sufficiently to produce a coating by accelerating metallic powder particles with a gas maintained at a temperature lower than a melting point of the sprayed material. SWIS differs from cold spray in that it is possible to achieve higher particle temperature at impact due to the unsteady nature of the process. Also, powder temperature is maintained at gas temperature unlike cold spray deposition, where a supersonic nozzle further accelerates and cools down the particles. Since cold spray requires extreme projection speeds to achieve proper particle deformation and adhesion onto the substrate, particle compaction is increased generally resulting in denser coatings. To alleviate this, deposition levels could be lowered, but this tends to negatively affect particle adhesion onto the substrate.

There remains a need for a technique for depositing porous metallic coatings, especially with the advantages of: higher temperature deposition (without particle melting); better porosity control in terms of volume fraction, and pore size, and good coating adhesion. By reducing heat treatment to less than 1000° C., the strength of the coated parts may be improved.

SUMMARY OF THE INVENTION

Applicant has found that the use of SWIS, in place of cold spray, can produce porous coatings at speeds lower than critical velocity, and with good adhesion and deposition efficiency. Good interparticle metallurgical contact, and shear and tensile properties higher than the ASTM standards required by the FDA, have been specifically observed with Ti feedstocks of 45 to 150 μm nominal size, and heat treatment of 850° C. Such coatings are useful in a variety of applications. Furthermore, we have demonstrated SWIS coating using different metals, such as titanium, aluminum, stainless steel, copper, nickel, alloys thereof, and mixtures thereof. The applications include abradables, medical implant coatings, electrodes, and fluid exchange media.

The present invention arose in research directed towards the development and characterization of porous metal coatings using ShockWave Induced Spraying (SWIS). The SWIS technology can advantageously generate porous coatings with slower speeds and deformation levels than cold spray. SWIS has been used in the past to generate dense coatings of various materials (27-30). To the best of our knowledge, the present non-obvious use of SWIS technology to generate porous coatings is unique. In contrast to the experimental system developed by Bertrand Jodoin (27-30) that deposits small amounts of powder, pulse by pulse over a very limited surface area, the WaveRider system (31) used for this invention is designed for industrial production and equipped with a powder feeding system and valve. By adjusting the delay between powder injection and valve opening to obtain a sub-optimal acceleration, powder particles were projected at gas temperature with speeds that minimize deformation during impact while ensuring adequate coating formation.

In comparison to vacuum plasma spray, the use of SWIS technology offers better productivity since a vacuum spray chamber is not needed, and less expensive infrastructure with lower capital investment, is required. Maintenance fees and costs of operation are also lower without the need for a vacuum chamber.

According to a first aspect, there is provided a method for producing a porous coating on a substrate. The method comprises the steps of:

- providing a particulate material having a given melting point and a given particle size distribution;
- providing a SWIS device comprising a tubular chamber with a uniform cross-sectional area having a spraying end and a gas inlet opposite the spraying end, and a gas supply fluidly connected to the gas inlet; where the gas supply contains a gas at a pressure higher than a pressure within the tubular chamber, the SWIS device comprising:
  - a first controllable valve located between the gas supply and gas inlet for regulating a flow of gas flowing in the tubular chamber from the gas inlet to the spraying end;
  - a powder feeding system having an outlet operatively connected to the tubular chamber downstream of the gas inlet to feed the particulate material into the tubular chamber; and
  - a heater for preheating the particulate material to a preheat temperature prior to delivery to the tubular chamber,
- maintaining the gas in the gas supply at a temperature lower than the melting point of the particulate material;
- directing the spraying end of the spraying device towards the substrate to coat;
- feeding the particulate material within the tubular chamber in a controlled manner; and coating the substrate by generating a pressure wave traveling along the tubular chamber from the gas inlet to the spraying end by opening and closing the controlling valve, the pressure wave accelerating the particulate material longitudinally within the tubular chamber towards the spraying end; and
- projecting the particulate material through the spraying end onto the substrate at an average particle velocity;

wherein, an amplitude and a frequency of the pressure wave, the preheat temperature, a feeding rate of the particulate material and the particle size distribution of the particulate material are chosen so that the average particle velocity allows a deposition of the particles while limiting a deformation of the particles to produce a porous coating on the substrate.

In an embodiment, the SWIS device further comprises a second controllable valve for regulating the feed of the particulate material into the tubular chamber.

In an embodiment, the method further comprises subjecting the substrate to a heat treatment following the coating of the particles on the substrate to improve interparticle metallurgical contact between the particles.

In an embodiment, the step of preheating the particulate material prior to feeding the particulate material within the tubular chamber is performed at a preheating temperature of between 50° C. to 1000° C. The step of preheating may be performed at a preheating temperature of 0.15 to 0.7 times the melting point of the particulate material in ° C., more preferably 0.3 to 0.6 times the melting point of the particulate material in ° C.

In an embodiment the average particle velocity is lower than a critical particle velocity. The average particle velocity may be 0.1 to 0.9 times the critical particle velocity, more preferably 0.3 to 0.7 times the critical particle velocity.

In an embodiment the particle size distribution has a nominal size of 1 micron or more, more preferably 45 micron or more, more preferably 45 to 300 microns, more preferably from 45 to 150 microns.

In an embodiment, the frequency of the pressure wave is from 1 to 100 Hz, more preferably from 5 to 40 Hz.

In an embodiment, the feeding rate of the particulate material is from 1 to 100 g/min.

In an embodiment, the porous coating has a porosity from 10% to 70%, more preferably from 20% to 50%, most preferably from 30% to 50%.

In an embodiment, the particulate material consists of metallic particles, or a combination of metal particles with ceramics, or cermets, especially with lower concentrations of the ceramic content. More preferably, the particulate material comprises: iron, copper, nickel, titanium, aluminum, chromium, zirconium, zinc, an alloy thereof, or a mixture thereof. More preferably the particulate material comprises: titanium, nickel, CoNiCrAlY, stainless steel, alloys thereof, or mixtures thereof.

In an embodiment, the gas is an inert gas, preferably nitrogen, although compressed air may be used, and the inert gas may further be a mixture of gasses with controlled amounts of helium to increase a speed of the spray jet. Preferably, maintaining the gas in the gas supply at a temperature lower than the melting point of the particulate material comprises maintaining a temperature of the gas from about 50° C. to about 1000° C., more preferably from about 500° C. to about 900° C., although this also depends on the feedstock. Preferably the gas at the pressure higher than the pressure within the tubular chamber is between 250 and 1000 psi, more preferably about 300 to 900 psi, or 400 to 800 psi, or 500 to 700 psi. Preferably the amplitude of the pressure wave is from 1 MPa to 7 MPa, preferably 2 to 4 MPa.

In an embodiment the coating is on: an implant; an electrode or is: an abradable seal or a fluid exchange media. The coating may be for an orthopedic application.

In an embodiment, the coating is performed under atmospheric pressure and does not require a vacuum chamber for the deposition.

In an embodiment, there is provided a use of a SWIS device for coating a substrate with a porous coating. The substrate may be an implant, preferably for orthopedic applications. The porous coating may be made of titanium or a titanium alloy. The use may provide the coating according to the method described hereinabove. The porous coating itself, and it's adhesion to the substrate may have a shear strength greater than 20 MPa; a tensile strength greater than 20 MPa; or a tensile strength greater than 40 MPa.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which.

DETAILED DESCRIPTION

In general terms, the present disclosure concerns a method for producing a porous coating using a ShockWave Induced Spraying (SWIS) device. The porous coating is produced and deposited on a substrate. The coating and substrate may form an implant, such as an orthopedic implant, or on an electrode, or the coating may be an abradable seal or a fluid exchange media. The method comprises spraying a particulate material using a SWIS device, while preheating the particulate material to a preheat temperature prior to delivery to a tubular chamber for shockwave pressurization, and maintaining supplied gas at a temperature lower than the melting point of the particulate material, to spray the particulate material at an average particle velocity; wherein, an amplitude and a frequency of the pressure wave, the preheat temperature, a feeding rate of the particulate material and the particle size distribution of the particulate material are chosen so that the average particle velocity allows a deposition of the particles while limiting a deformation of the particles to ensure that the porous coating is produced on the substrate.

Figure 1:
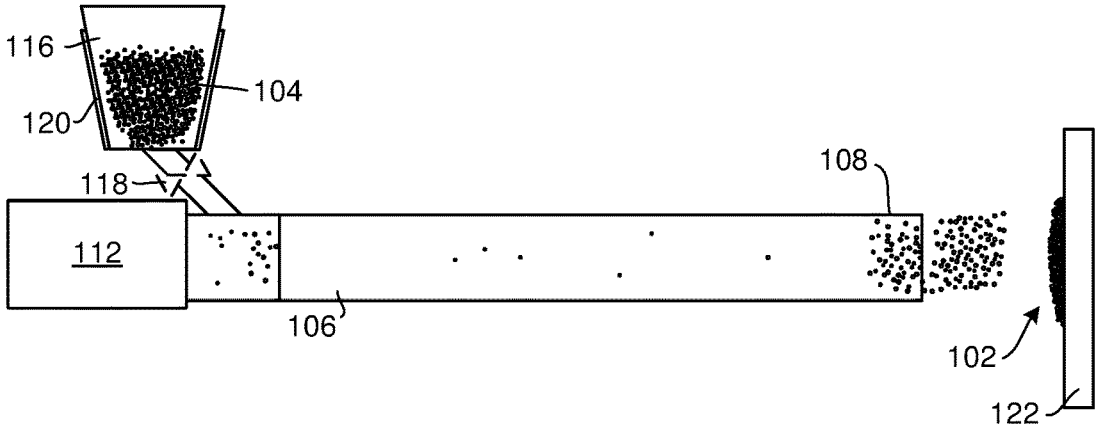
FIG. 1 is a schematic side cross-section view of a SWIS device.

FIG. 1 is a schematic illustration of a SWIS device 100. The SWIS device 100 has a tubular chamber 106 having a substantially uniform cross-sectional area (in comparison with a deLaval type nozzle used in cold spray) with a spray nozzle 108 at a far end. The spray nozzle 108 may be chamfered at the nozzle end with an angle of less than 0.5°, over the last 8% of the extent of the tubular chamber 106, as was the WaveRider device used to demonstrate the present invention. The tubular chamber 106 is y coupled at a near end to both powder supply 116 and gas supply 112. The uniform cross-sectional area along the length of the tubular chamber 106 allows the gas flow travelling down the tubular chamber 106 to be maintained at a substantially constant temperature. This constant temperature delivers the particulate material 104 to substrate 122 with a higher temperature, and is found to provide increased deposition efficiency, at lower velocity, and indeed below the critical velocity limit of cold spray deposition. The gas temperature may be between about 50° C. to about 1000° C., or about 500° C. to about 900° C., depending on the feedstock material.

A gas supply 112 is in controlled fluid connection with the y coupler. The gas contained in the gas supply 112 is pressurized to a pressure higher than that of the tubular chamber 106, using known pressurized gas supplies, valves, and heaters, preferably with the valves upstream of the heater. The pressure of the gas in the gas supply 112 may be between 250 and 1000 psi. The connection of the gas supply 112 with the inside of the tubular chamber 106 is controlled by a first valve, located between the pressurized gas supply and the heater. The first valve allows a control of the gas flow into the tubular chamber 106 of the shockwave induced spraying device 100.

The SWIS device 100 further comprises a powder feeding system 116 for feeding particulate material 104 to an inside of the tubular chamber 106 via they coupler. The powder feeding system 116 includes a container for holding a feedstock powder 104, that is connected to the tubular chamber 106. The powder feeding system 116 allows for controlled delivery of particulate material 104 to the tubular chamber 106. For example, the feeding rate of the particulate material 104 can be from 1 to 100 g/min. This control is shown to be provided by an optional second valve 118 between the powder feeding system 116 and the tubular chamber 106 to regulate the amount and/or timing of particulate material 104 being fed to the tubular chamber 106. In the embodiment used for proof of concept, the SWIS device, referred to herein is the WaveRider system, uses a volumetric powder feeder for varying a federate, by changing a rotation speed of a wheel, however a valve 118 may be preferred in future embodiments. It will be noted that by leaving the second valve 118 open or partially open during the pressurization of the chamber 106, pulses of pressure expand into the powder feeding system 116 at the regularity of the pressure waves. This is effective for decreasing a speed with which the powder jet strikes the surface, in accordance with the present invention.

The powder feeding system 116 further includes a heater 120 for preheating the particulate material 104 to a preheat temperature prior to its delivery into the tubular chamber 106. The preheat temperature may be substantially similar to the gas temperature, which can contribute to an increased deposition efficiency. The preheat temperature may be between 50° C. to 1000° C. The preheat temperature to which the particulate material 104 is preheated is preferably a fraction less than one, of the melting point of the particles or a lowest melting point of the constituents thereof; for example the fraction ranging from 0.15 to 0.7, or more preferably from 0.3 to 0.6.

A particulate material 104 is provided in the container. The particulate material 104 may be metallic particles, cermet particles, or a combination of metal and ceramic particles. Particles of the particulate material 104 have a melting point and a given particle size. In an embodiment, the particulate material be a metal such as iron, copper, nickel, titanium, aluminum, chromium, zirconium and zinc. The particles can also comprise an alloy of those metals. In the embodiment wherein the particulate material also comprises ceramic particles, the ceramic particles can comprise titania, zirconia, alumina or a combination thereof, with total ceramic content being less than 20 wt. %, more preferably less than 10 wt. %, more preferably less than 5 wt. %. The particles may have a nominal size greater than 1 micron, such as a nominal size from 45 to 300 microns, or from 45 to 150 micron. The powders may have any morphology, granulometry, coating or structuration, as these features of powders are known to improve or alter deposition efficiency, porosity, or adhesion properties.

Using the SWIS device 100, the SWIS process (also known as pulsed gas dynamic spray) accelerates feedstock powder particles with a gas maintained at a lower temperature than the melting point of the powder(s). In order to do so, pulses of a high pressure gas are induced in a tube, thereby creating shockwaves that accelerate the particles towards the substrate. Hence, the SWIS process is inherently a discontinuous process. Of note, the powder temperature is maintained at substantially the same temperature as the gas, contrary to the cold spray deposition, where a supersonic nozzle further accelerates and cools down the particles.

The SWIS process may involve adjusting a rate of the powder injection, the powder temperature, as in other thermal and cold spray processes, but additionally allows for adjustment of a rate of the opening of the first valve (or the relative opening and closing timings of first and second (118) valves), which is particularly useful for controlling powder acceleration. We here show that powder particles can be projected at the gas temperature with speeds that reduce the deformation of the particles upon impact, while ensuring an adequate coating formation in terms of deposition efficiency and deposition rate. The SWIS process can generate porous coatings by depositing with slower speeds and with lower deformation levels than cold spray.

In comparison with vacuum deposition, the coating can be done under atmospheric pressure and does not require a vacuum deposition chamber. This makes the deposition easier than with vacuum plasma spray method (no need to generate a vacuum with a pressurized gas emitting particulate spray nozzle, faster cycle time, no maintenance of the vacuum system). The size of the object to be coated is not restricted to the size of the vacuum chamber.

Figure 2:
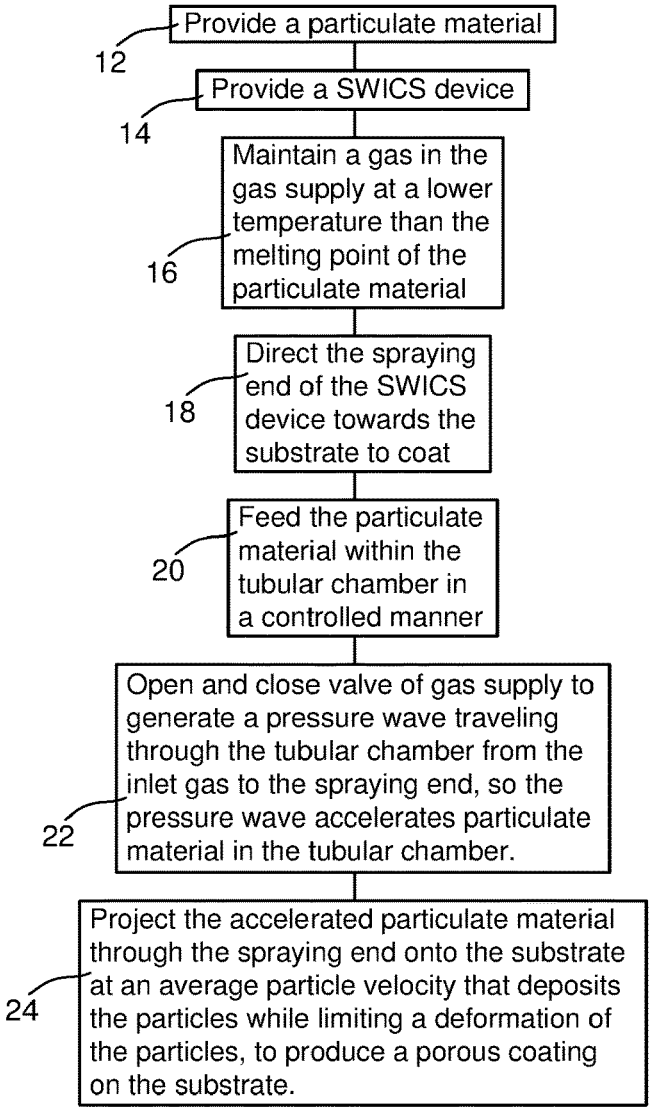
FIG. 2 is a flowchart for a method for producing a porous coating using a SWIS device, in accordance with an embodiment of the present invention.

According to a first aspect of the invention and referring to FIG. 2, there is provided a method 10 for producing a porous coating 102 using SWIS device 100. The method 10 includes the following steps.

A particulate material 104 is provided at step 12. The particulate material 104 is suitable for the SWIS process as described above. The SWIS device 100 is then provided step 14. The SWIS device 100 is preferably the WaveRider System™ or a modified WaveRider System™ with the valve 118 as shown in FIG. 1. A gas in the gas supply 112 is provided at a temperature lower than the melting point of the particulate material 104 (step 16) and the spraying end 108 of the SWIS device 100 is directed towards the substrate 122 to be coated (step 18). The particulate material 104 is then dispensed into the tubular chamber 106 by the powder feeding system 116 in a controlled manner (step 20). The feeding of the particulate material 104 into the tubular chamber 106 may occur at regular time intervals with variable, or constant, amounts of the particulate material 104 entering the tubular chamber 106 in each interval (in steady state). This amount may influence a speed at which the particulate material 104 exits the spraying end 102. The controlled manner of dispensing the particulate material 104 further comprises preheating the powder to a temperature that is also below the melting point, with heater 120.

The gas supply is actuated to generate a pressure wave, by opening and closing the first valve, which is a part of gas supply 112. The pressure wave is propagated through the tubular chamber 106 from the gas inlet 110 to the spraying end 108 (step 22). The pressure wave accelerates the particulate material 104 longitudinally through the spraying end 108, and is projected onto the substrate with an average particle velocity.

The pressure wave can be generated by opening and the closing the first valve at a given rate to produce a regular series of pressure waves. As the pressure waves are generated, particulate material 104 injected since the last feed, is projected at each pulse.

In this method, the amplitude and the frequency of the pressure wave, the preheat temperature, the feeding rate of the particulate material and/or the particle size of the particulate material can be adjusted so that the average particle velocity allows a deposition of the particles while limiting the deformation of the particles (step 24). The amplitude of the pressure wave may be from 1 to 7 MPa, or more preferably from 2 to 4 MPa. The frequency of the pressure waves can be from 1 to 100 Hz, more preferably from 5 to 40 Hz.

The steps of this method are not inherently ordered, in as much as there are continuous processes for feeding powder, heating powder, heating gas, supplying gas in pulses, and moving the nozzle with respect to the substrate to produce coatings, as will be appreciated by those of skill in the art.

Limiting the deformation of the particles can result in a coating that is porous in contrast to a dense coating, in which particles are highly deformed. The average particle velocity must be sufficient to ensure an adhesion of the particles to the substrate 122, but also low enough to limit the deformation of the particles, for example, so that a porous coating can be obtained. The average particle velocity that allows deposition of a porous coating may be lower than a critical particle velocity. Herein the critical particle velocity is the minimal impact velocity required for the particles to be deposited on a substrate with at least 10% deposition efficiency is reliably produced. The critical particle velocity is determined by time of flight particle measurement on cold spray conditions at which 10% deposition efficiency is observed. The average particle velocity may be from 0.1 to 0.9 times the critical particle velocity, more preferably from 0.3 to 0.7 times the critical particle velocity.

The average particle velocity depends on the particle size, the pressure amplitude of the pressure wave and a length of time that the first valve is opened. Thus the average particle velocity can be reduced by: using a coarser particulate material; decreasing the pressure of the gas in the gas supply 112; or decreasing a time that the first valve is opened. Applicant also finds a variation based on a frequency of the pressure waves, for some feedstocks.

Moreover, the average particle velocity as well as the particles size distribution can influence a porosity of the porous coating. The porous coating may have a porosity ranging from 10% to 50%, or more preferably from 20% to 40%, as measured using ASTM B962.

Optionally, the coating of the substrate 122 may be followed by a heat treatment to improve metallic bonds at an interface between the particles. The heat treatment may be annealing. For titanium coatings, the heat treatment can advantageously be performed below 1000° C., reducing damage to, and increasing a range of, suitable substrates. If the metal is reactive at the temperature of the heat treatment, it is performed in a protected environment, such as an argon atmosphere or in a vacuum.

Example 1 Ti

Two types of titanium powder particles (Wah Chang CP Ti −75/+45 μm and Reading Ti alloy −149/+44 μm) were shockwave induced sprayed onto Ti6Al4V cylindrical tensile (d=1") and shear (d=0.75") substrates using the WaveRider system, which is substantially as shown in FIG. 1, except that the valve 118 is not provided. Further details on this system is provided, for example in Journal of Thermal Spray Technology, v20(4)pp. 866-881, June 2011), which is incorporated herein by reference. The WaveRider system was used following parameters:

| | |
|---|---|
| Gas | Nitrogen |
| Gas temperature | 800° C. |
| Pressure | 600 psi |
| Frequency | 30 Hz |
| DDP | 25 mm |
| Powder temperature | 600° C. |
| Powder rate | 2.7 g/min (Wah Chang); 4.9 g/min (Reading) |
| Step size | 2 mm |
| Robot speed | 10 mm/sec |
| # pass | 1 |

Table 2. Parameters Used for Shockwave Induced Spraying

Post deposition, the samples were subjected to a heat treatment for 1 hr at 850° C. in a high vacuum (diffusion pump) furnace.

Figure 3:
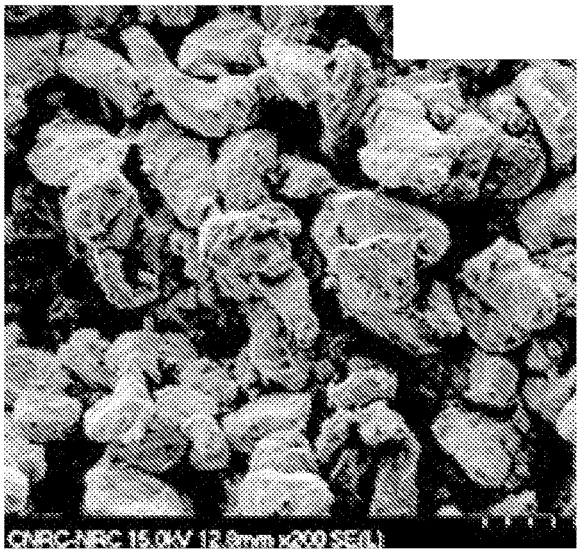
FIG. 3 is a micrograph image of Wah Chang CP Ti powder feedstock −75/+45 μm.
Figure 4:
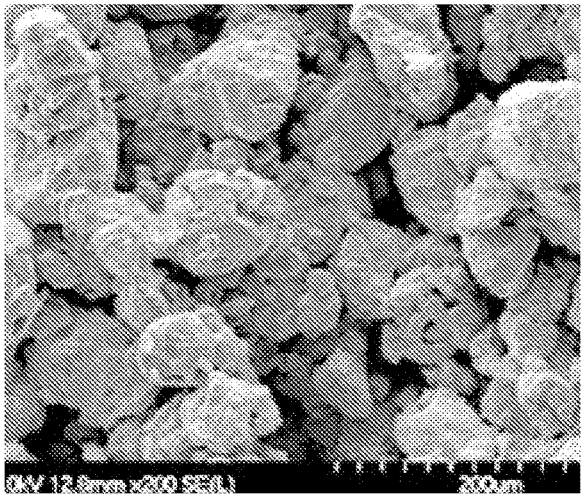
FIG. 4 is a micrograph image of Reading Ti alloy powder feedstock −149/+44 μm.

The Wah Chang and Reading powders were examined, and are shown as FIGS. 3, 4, respectively. Preliminary experiments conducted without the post-deposition heat treatment showed partial metallic bonds at the interface between particles and the coating-substrate interface. After heat treatment, good interparticle metallurgical contact was created with both powders. Heat treatment did not cause important modification of the uncoated substrate surface as practically no thermal etching lines were observed on the Ti6Al4V.

Figure 5:
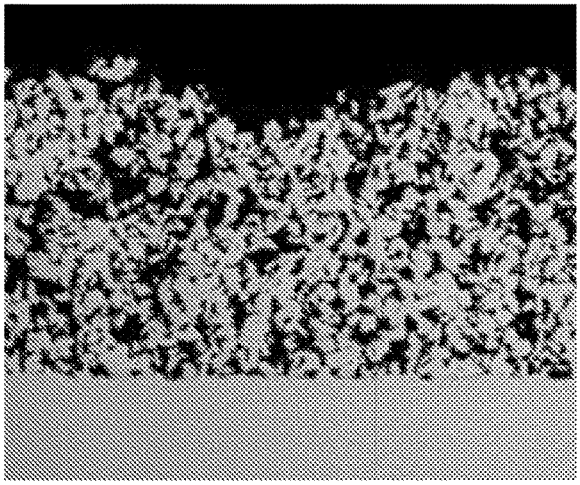
FIG. 5 is a micrograph image of a coating produced using the powder of FIG. 3.
Figure 6:
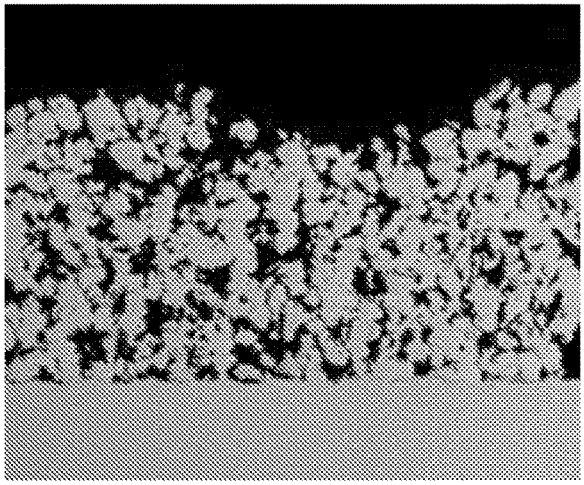
FIG. 6 is a micrograph image of a coating produced using the powder of FIG. 4.
Figure 5A:
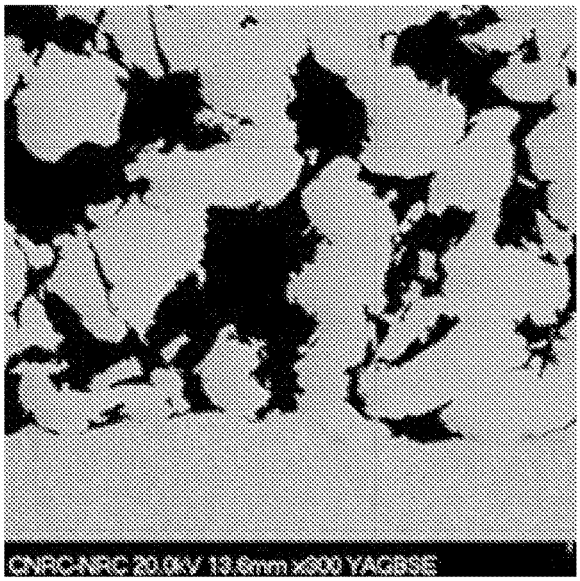
FIG. 5A is an enlarged micrograph image of the coating of FIG. 5.
Figure 6A:
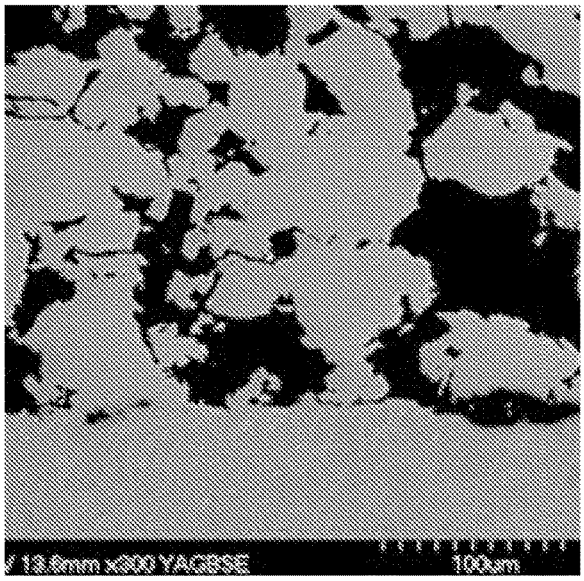
FIG. 6A is an enlarged micrograph image of the coating of FIG. 6.

FIGS. 5, 6 are coating cross-section images of the heat treated coatings produced respectively from the Wah Chang and Reading powders. Coating thickness for both samples varied from 0.7 to 1.1 mm, probably associated with a non-optimized step size and/or frequency/traverse speed. FIGS. 5A, and 6A are enlarged views near the substrate interface of the same coatings. Scanning electron microscopy examination of shockwave induced sprayed porous titanium coatings using Wah Chang and Reading particle powders shows excellent surface roughness and gripping. Porosities of 37 and 33% were obtained using Wah Chang and Reading powders respectively, both within the range obtained with vacuum plasma spray. Deposition efficiency was 51 and 60% using Wah Chang and Reading powders, respectively. Larger pores were obtained using Reading powder, likely due to the larger particle size distribution.

Shear and tensile tests were performed on both groups to evaluate the shear and tensile strengths of the porous coatings. Both groups ruptured in the adhesive used to join adjacent parts during tensile and shear testing. This translates in shear strength >31.7±3.6 MPa and tensile strength >69 MPa for samples fabricated using Wah Chang powders and shear strength >31.3±1.4 MPa and tensile strength >69 MPa for coatings composed of Reading powders. These properties are much higher than the ASTM standard requirement for shear (20 MPa) and tensile (22 MPa) strengths. Heat treatment post-deposition was required to obtain strong bonding properties as shear and tensile strengths of samples 'as sprayed' were well under the targeted standard requirements. In applications where the mechanical strength are not critical (e.g.: electrodes), the material could be used without heat treatment.

Example 2 CoNiCrAlY

Figure 7:
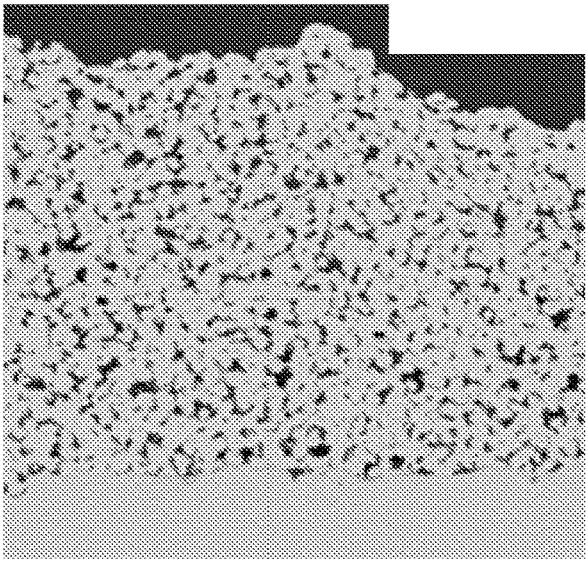
FIG. 7 is a micrograph image of a coating produced using CoNiCrAlY powder feedstock −45/+20 μm.
Figure 8:
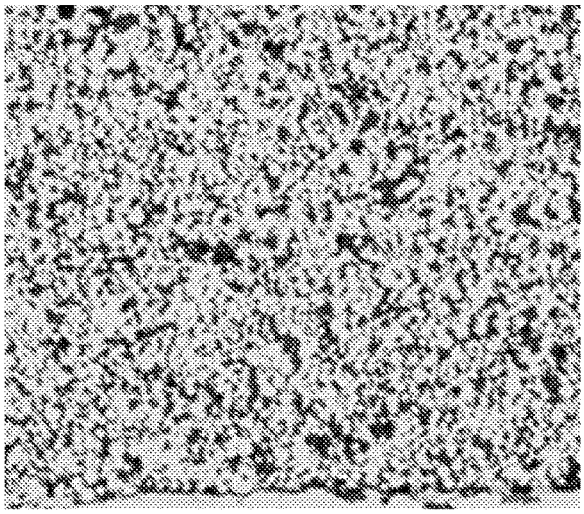
FIG. 8 is a micrograph image of a coating produced using CoNiCrAlY powder feedstock −38/+10 μm.
Figure 9:
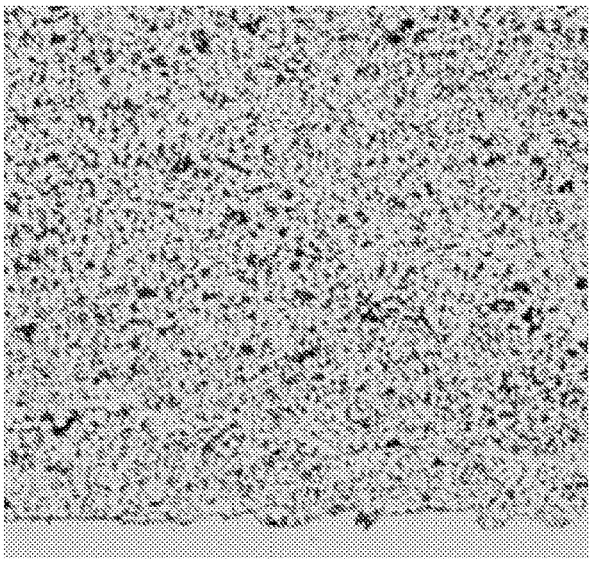
FIG. 9 is a micrograph image of a coating produced using CoNiCrAlY powder feedstock −23/+5 μm.

Scanning electron microscopy examination of CoNiCrAlY coatings deposited via SWIS are shown as FIGS. 7-9. Microstructure and porosity of the coatings (even the pore size) can be tuned by choosing the appropriate granulometry of the powder feedstock and spray parameters. Specifically these coatings were produced with the same process parameters as for the Ti coatings, except: the gas pressure was 700 psi; DDP was 5 mm; the powder temperature was at room temperature; the powder feed rate was not monitored; and the step size was 1 mm; the traverse speed was 5-10 mm/s; and the coating was deposited in 3-5 passes. Coatings deposited using Oerlikon Metco feestock powders having sizes −45/+20 μm, −38/+10 μm, and −23/+5 μm resulted in coating with porosities of 16.4%, 30.5%, and 22% respectively, as shown in FIGS. 7, 8 and 9.

Example 3 Cu

Figure 10:
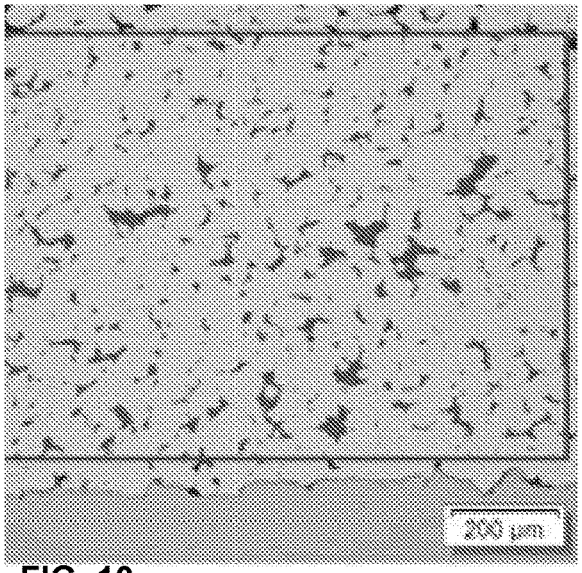
FIG. 10 is a micrograph image of a coating produced using coarse Cu powder feedstock at 30 Hz operation of the SWIS device.
Figure 11:
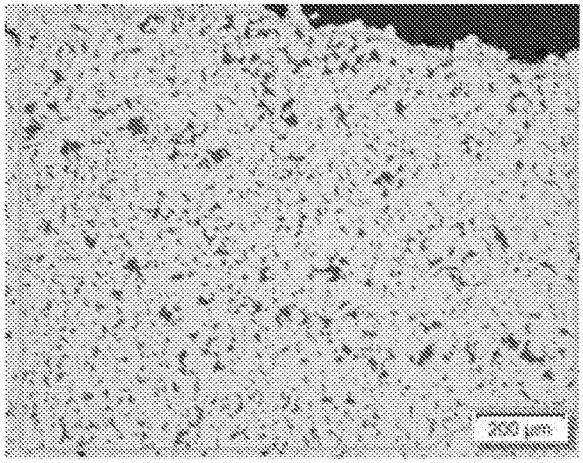
FIG. 11 is a micrograph image of a coating produced using fine Cu powder feedstock at 30 Hz operation of the SWIS device.
Figure 12:
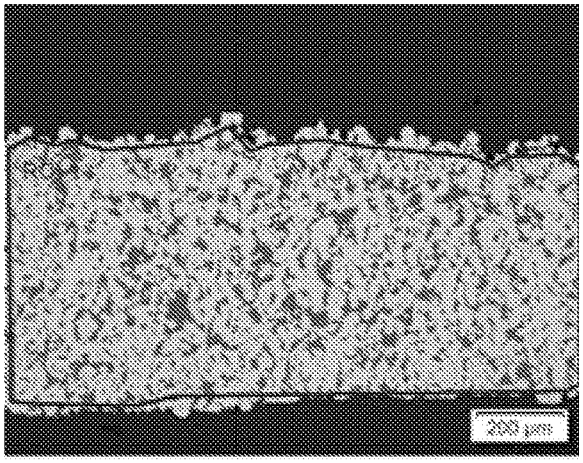
FIG. 12 is a micrograph image of a coating produced using fine Cu powder feedstock at 50 Hz operation of the SWIS device.
Figure 13:
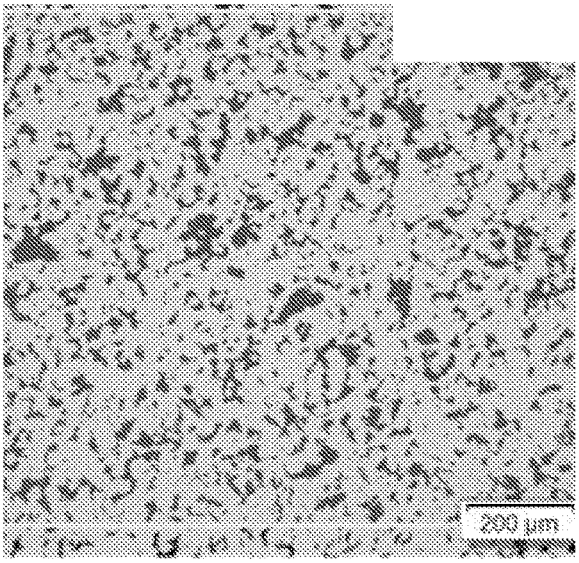
FIG. 13 is a micrograph image of a coating produced using Ni feedstock powder (Amperit) with a porosity of 17% and pore size below 142 μm.
Figure 14:
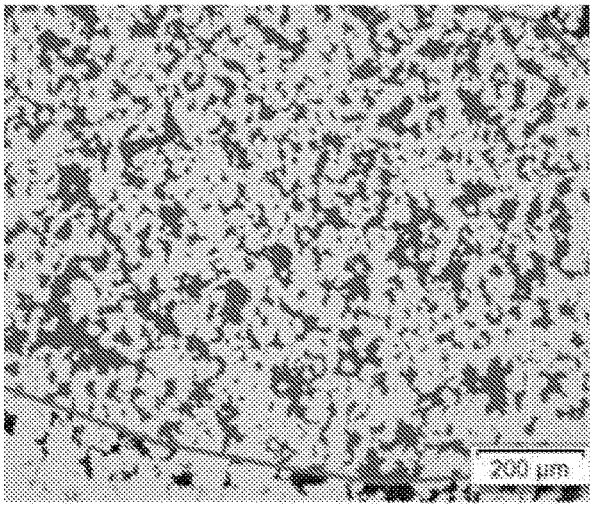
FIG. 14 is a micrograph image of a coating produced using Ni feedstock powder (Amperit) with a porosity of 26% and pore size below 400 μm.
Figure 15:
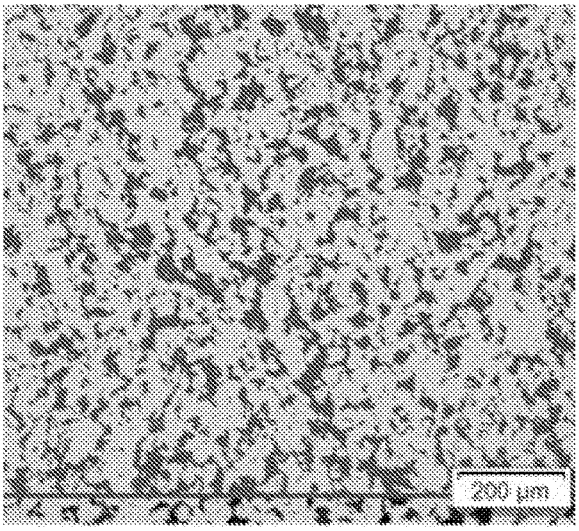
FIG. 15 is a micrograph image of a coating produced using Ni feedstock powder (Praxair) with a porosity of 23%.
Figure 16:
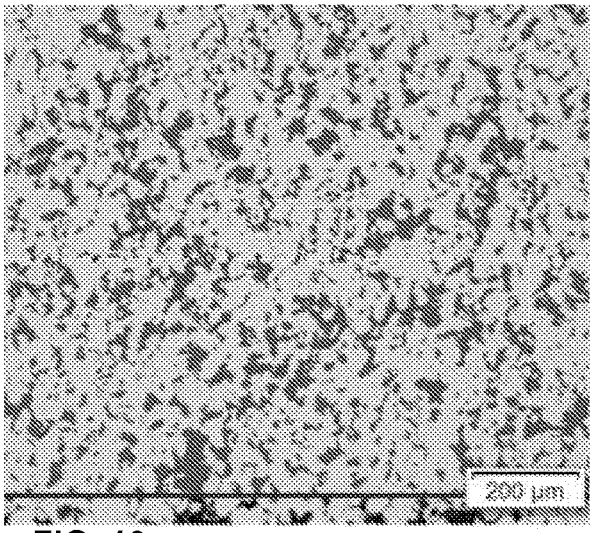
FIG. 16 is a micrograph image of a coating produced using Ni feedstock powder (Praxair) with a porosity of 20%.
Figure 17:
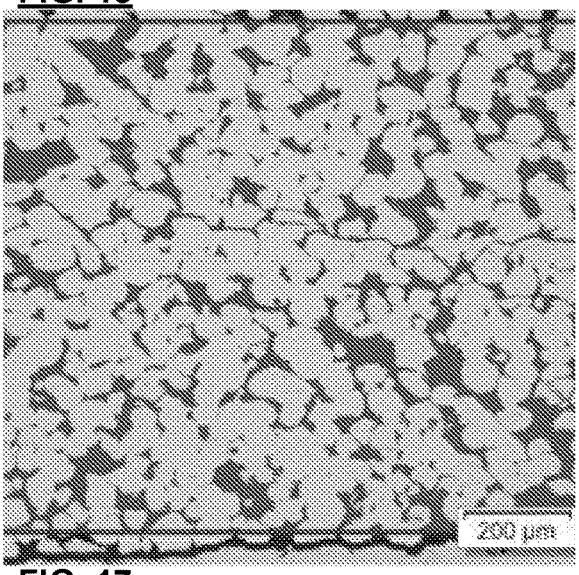
FIG. 17 is a micrograph image of a coating produced using stainless steel feedstock powder and pore size below 800 μm.
Figure 18:
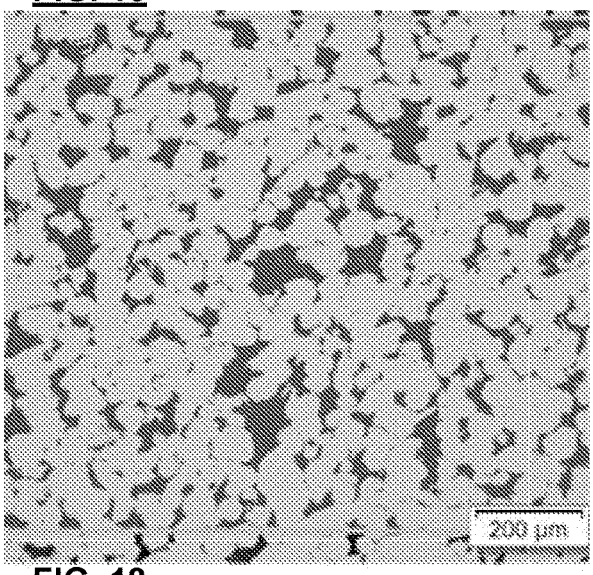
FIG. 18 is a micrograph image of a coating produced using stainless steel feedstock powder and pore size below 360 μm.

Two types of copper powder particles (Plasma Giken PG-PMP-1015 coarse 75 μm and Plasma Giken PG-PMP-1012 fine 20 μm) were SWIS sprayed onto mild steel substrates to form coatings. SEM images of these coatings are provided as FIGS. 10, 11, and 12. Specifically these coatings were produced with the same process parameters as for the Ti coatings, except: the gas temperatures ranged from 300-400° C.; DDP was 20 mm; the powder temperatures were unheated; powder rate was not monitored; step size was 1 mm; traverse speed was only 5 mm/s; the coating was produced in 2 passes; and a different frequencies (e.g. 30-50 Hz) were used in the different coatings. Coating microstructure, porosity and pore size can be tuned over a wide range by choosing the appropriate granulometry of the powder feedstock and spray parameters. Porosity of 7% and 20% were produced with pore sizes below 142, 100, and 215 microns. FIGS. 10 and 11 show 7% porosities with the coarse and fine powders, respectively, and FIG. 12 shows 20% porosity with the fine powder at the higher frequency pulse train.

Example 4 Ni

Three types of nickel powders e.g. Praxair Ni101 (−45/+11 μm), Praxair Ni 969 (−75/+45 μm) and HC Starck Amperit 176.068 (−35/+15 μm) were deposited according to the invention, onto mild steel substrates. Specifically these coatings were produced with the same process parameters as for the Ti coatings, except: the gas temperatures ranged from 500-600° C.; DDP was 10 mm; the powder temperatures were unheated; powder rate was not monitored; step size was 1 mm; traverse speed was 5 to 10 mm/s; and the coating was produced in 2 passes. Porosities of 17-26% were produced with pore sizes below 400, 350, and 142 μm.

Example 5 Stainless Steel

Stainless steel SS316L feedstock from Sandvik was deposited according to the invention, onto mild steel substrates. The feedstock had a particle size distribution −75/+45 μm. Specifically these coatings were produced with the same process parameters as for the CoNiCrAlY coatings, except that the DDP was 20 mm, traverse speed was 5 mm/s; and the coating was produced in 2 passes.

None of these experiments leveraged the powder heating capabilities of the WaveRider device, and it is considered that preheating the powders will allow for deposition at lower velocities, to produce higher porosity coatings, with higher deposition efficiencies. The results clearly show that a wide range of metals, and likely cermets with low ceramic content, can be sprayed to produce porous coatings in accordance with the present invention.

Other advantages that are inherent to the structure are obvious to one skilled in the art. The embodiments are described herein illustratively and are not meant to limit the scope of the invention as claimed. Variations of the following embodiments will be evident to a person of ordinary skill and are intended by the inventor to be encompassed by the following claims.

REFERENCES

1. Ryan G, Pandit A, Apatsidis D P. Fabrication methods of porous metals for use in orthopaedic applications. Biomaterials 2006; 27: 2651-2670.
2. Matassi F, Botti A, Sirleo L, Carulli C, Innocenti M. Porous metals for orthopedics implants Clinical Cases in Mineral and Bone Metabolism 2003; 10(2):111-115.
3. Messersmith P B, Cooke F W. Stress enhancement and fatigue susceptibility of porous coated Ti-6Al-4V implants: an elastic analysis. J Biomed Mater Res 1990; 24: 591-604.
4. Simmons C A, Valiquette N, Pilliar R M. Osseointegration of sintered porous-surfaced and plasma spray-coated implants: An animal model study of early postimplantation healing response and mechanical stability. J. Biomed Mater Res 1999, 47, 127-138.
5. Wolfarth D, Ducheyne P. Effect of a change in interfacial geometry on the fatigue strength of porous-coated Ti-6A1-4V. J Biomed Mater Res 1994; 28:417-25.
6. Yue S, Pilliar R M, Weatherly G C. The fatigue strength of porous-coated Ti-6% Al-4% V implant alloy. J Biomed Mater Res 1984; 18:1043-58.
7. Martell J M, Pierson III R H, Jacobs J J, Rosenberg A G, Maley M, Galante J O. Primary total hip reconstruction with a titanium fiber-coated prosthesis inserted without cement. J Bone Joint Surg Am 1993; 75:554-71.
8. Ducheyne P. Orderly oriented wire meshes as porous coatings on orthopaedic implants I: Morphology. Clinical Materials 1986; 1:59-67.
9. Fabi D W, Levine B R. Porous Coatings on Metallic Implant Materials. ASM Handbook, Volume 23: Materials for Medical Devices. 2012:307-319.
10. U.S. Pat. No. 7,854,958B2
11. Gardon M, Latorre A, Torrell M, Dosta S, Fernandez J, Guilemany J M. Cold gas spray titanium coatings onto a biocompatible polymer. Materials Letters. 2013:97-99.
12. Price T S, Shipway P H, McCartney D G. Effect of cold spray deposition of a titanium coating on fatigue behavior of a titanium alloy. Journal of Thermal Technology. 2006; 15 (4): 507-512.
13. Marrocco T, McCartney D G, Shipway P H. Production of titanium deposits by cold gas dynamic spray. TWI. 2005.
14. Li C J, Li W Y. Deposition characteristics of titanium coating in cold spraying. Surface and Coatings Technology. 2003; 167:278-283.
15. Choudhuri A, Mohanty P S, Karthikeyan J. Bio-ceramic composite coatings by cold spray technology. ASB Industries.
16. Qiu D, Zhang M, Grondahl L. A novel composite porous coating approach for bioactive titanium-based orthopedic implants. Society for Biomaterials. 2012:862-872.
17. Sun J, Han Y, Cui K. Innovative fabrication of porous titanium coating on titanium by cold spraying and vacuum sintering. Materials Letters. 2008; 62:3623-3625.
18. Li W Y, Zhang C, Guo X, Xu J, Li C J, Liao H, Coddet C, Khor K A. Ti and Ti-6Al-4V coatings by cold spraying and microstructure modification by heat treatment.
19. Vo P, Irissou E, Legoux J G, Yue S. Mechanical and microstructural characterization of cold-sprayed Ti-6Al-4V after heat treatment.

20. Zahiri S H, Fraser D, Jahedi M. Recrystallization of cold spray-fabricated CP titanium structures. Journal of Thermal Spray Technology. 2009; 18(1):16-22.
21. R. E. Blose, B. H. Walker, R. M. Walker, and S. H. Froes, New Opportunities to Use Cold Spray Process for Applying Additive Features to Titanium Alloys, Met. Powder Rep., 2006, 61(9), p 30-37
22. R. Blose, Spray Forming Titanium Alloys Using the Cold Spray Process, Thermal Spray 2005: Thermal Spray Connects: Explore Its Surfacing Potential!, E. Lugscheider Ed., ASM International, Materials Park, O H, 2005, p 199-207
23. W. Y. Li, X. P. Guo, C. Verdy, L. Dembinski, H. L. Liao, C. Coddet, *Scr. Mater.* 2006, 55, 327.
24. T. Stoltenhoff, C. Borchers, F. Gärtner, H. Kreye, *Surf. Coat. Technol.* 2006, 200, 4947.
25. H. Y. Lee, S. H. Jung, S. Y. Lee, K. H. Ko, *Mater. Sci. Eng*. A 2006, 433, 139.
26. W. Y. Li, C. J. Li, and H. L. Liao, Effect of Annealing Treatment on the Microstructure and Properties of Cold-Sprayed Cu Coating, J. Therm. Spray Technol., 2006, 15(2), p 206-211
27. U.S. Pat. No. 8,298,612B2
28. M. Karimi, G. W. Rankin, B. Jodoin, "Shock-wave induced spraying: Gas and particle flow and coating analysis", *Surface and Coatings Technology*, Volume 207, August 2012, p. 435-442
29. M. Yandouzi, H. Bu, M. Brochu and B. Jodoin, "Nanostructured Al-Based Metal Matrix Composite Coating Production by Pulsed Gas Dynamic Spraying Process", Journal of Thermal Spray Technology, 2012, Volume 21, Numbers 3-4, Pages 609-619
30. B. Jodoin, P. Richer, G. Bérubé, L. Ajdelsztajn, M. Yandouzi, "Pulsed-Gas Dynamic Spraying: Process Analysis, Development and Selected Coating Examples", Surface and Coatings Technology, Volume 201 (16-17), May 2007, p. 7544-7551
31. U.S. Pat. No. 8,192,792B2

The invention claimed is:

1. A method for producing a porous coating on a substrate; the method comprising:

providing a particulate material having a given melting point and a given particle size distribution;

providing a ShockWave Induced Spraying (SWIS) device comprising a tubular chamber with a generally uniform cross-sectional area having a spraying end and a gas inlet opposite the spraying end, and a gas supply fluidly connected to the gas inlet, where the gas supply contains a gas at a pressure higher than a pressure within the tubular chamber, the SWIS device comprising:

a first controllable valve located between the gas supply and gas inlet for regulating a flow of gas into the tubular chamber from the gas inlet;

a powder feeding system having an outlet operatively connected to the tubular chamber downstream of the gas inlet to feed the particulate material into the tubular chamber; and a heater for preheating the particulate material to a preheat temperature prior to delivery to the tubular chamber, maintaining the gas in the gas supply at a temperature lower than the melting point of the particulate material;

directing the spraying end of the spraying device towards the substrate;

feeding the particulate material within the tubular chamber in a controlled manner;

generating a pressure wave traveling along the tubular chamber from the gas inlet to the spraying end by opening and closing the controlling valve, the pressure wave accelerating the particulate material longitudinally within the tubular chamber towards the spraying end; and projecting the particulate material through the spraying end onto the substrate at an average particle velocity to coat the substrate;

wherein, an amplitude and a frequency of the pressure wave, the preheat temperature, a feeding rate of the particulate material, and the particle size distribution of the particulate material are chosen to produce a coating on the substrate having a porosity of at least 10%.

2. The method of claim 1 where the SWIS device further comprises a second controllable valve for regulating the feed of the particulate material into the tubular chamber.

3. The method of claim 1 further comprising heat treating the coating on the substrate after deposition, to improve interparticle metallurgical contact.

4. The method of claim 3 where after heat treatment the porous coating has a shear strength greater than 20 MPa, or a tensile strength greater than 20 MPa.

5. The method of claim 1 where the particulate material is preheated at a preheating temperature of between 50° C. to 1000° C. prior to delivery to the tubular chamber.

6. The method of claim 1 where the particulate material is preheated at a preheating temperature of 0.15 to 0.7 times a melting point of the particulate material measured in ° C. prior to delivery to the tubular chamber.

7. The method of claim 6 where the preheating temperature is 0.3 to 0.6 times a melting point of the particulate material measured in ° C.

8. The method of claim 1 where the average particle velocity is lower than a critical particle velocity of the feedstock.

9. The method of claim 8 where the average particle velocity is 0.1 to 0.9 times the critical particle velocity.

10. The method of claim 1 where the particle size distribution has a nominal size of: 1 45 μm or more; between 45 and 300 μm; or between 45 and 150 μm.

11. The method of claim 1 where pressure waves are generated in a regular pulse train, the pulse train having a frequency of 1 to 100 Hz.

12. The method of claim 11 where the frequency of the pulse train is from 5 to 80 Hz.

13. The method of claim 1 where the feeding rate of the particulate material is from 1 to 100 g/min, or the porous coating has a porosity from 10% to 50%.

14. The method of claim 13 where the porous coating has a porosity from 20% to 40%.

15. The method of claim 1 where the particulate material consists of metallic particles, cermets, or a combination of metal particles with ceramic particles with less than 10 wt. % ceramic content.

16. The method of claim 1 where the particulate material consists essentially of: iron, copper, nickel, titanium, aluminum, chromium, zirconium, zinc, an alloy thereof, or a mixture thereof.

17. The method of claim 16 where particulate material consists essentially of: titanium, copper, nickel, CoNiCrAlY, or stainless steel.

18. The method of claim 1 where the gas is nitrogen or air.

19. The method of claim 1 where maintaining the gas in the gas supply at a temperature lower than the melting point of the particulate material comprises maintaining a temperature of the gas from about 50° C. to about 1000° C.

20. The method of claim 1 where the pressure of the gas in the gas supply is between 250 and 800 psi; the amplitude of the pressure wave is from 1 MPa to 7 MPa; or the coating is performed under atmospheric pressure.

* * * * *